US011293110B2

(12) United States Patent
Zhu et al.

(10) Patent No.: US 11,293,110 B2
(45) Date of Patent: Apr. 5, 2022

(54) METHOD FOR EXTRACTING URANIUM WITH COUPLING DEVICE OF WIND POWER GENERATION AND URANIUM EXTRACTION FROM SEAWATER

(71) Applicant: SOUTHWEST UNIVERSITY OF SCIENCE AND TECHNOLOGY, Mianyang (CN)

(72) Inventors: Wenkun Zhu, Mianyang (CN); Rong He, Hefei (CN); Yi Li, Bazhong (CN); Tao Duan, Mianyang (CN); Jia Lei, Nanchong (CN); Tao Chen, Wuhu (CN); Fan Yang, Mianyang (CN)

(73) Assignee: SOUTHWEST UNIVERSITY OF SCIENCE AND TECHNOLOGY, Mianyang (CN)

( * ) Notice: Subject to any disclaimer, the term of this patent is extended or adjusted under 35 U.S.C. 154(b) by 0 days.

(21) Appl. No.: 17/433,682

(22) PCT Filed: Dec. 15, 2020

(86) PCT No.: PCT/CN2020/136445

§ 371 (c)(1),
(2) Date: Aug. 25, 2021

(87) PCT Pub. No.: WO2021/121213

PCT Pub. Date: Jun. 24, 2021

(65) Prior Publication Data

US 2022/0042194 A1 Feb. 10, 2022

(30) Foreign Application Priority Data

Dec. 19, 2019 (CN) ..... 201911319233.7

(51) Int. Cl.
*C25C 7/00* (2006.01)
*C25C 1/00* (2006.01)
(Continued)

(52) U.S. Cl.
CPC ..... *C25C 7/02* (2013.01); *C22B 60/0217* (2013.01); *C25C 1/22* (2013.01); *C25C 7/06* (2013.01)

(58) Field of Classification Search
CPC .... C25C 1/00; C25C 7/02; C25C 1/22; C25C 3/34; C25C 3/00; C25C 7/00; C25C 7/06;
(Continued)

(56) References Cited

U.S. PATENT DOCUMENTS

2007/0158196 A1 7/2007 Kang et al.

FOREIGN PATENT DOCUMENTS

CN 101357324 A 2/2009
CN 106098130 A 11/2016
(Continued)

OTHER PUBLICATIONS

Chong Liu, et al., A half-wave rectified alternating current electrochemical method for uranium extraction from seawater, nature energy, 2017, pp. 1-8, vol. 2 No. 17007.
(Continued)

*Primary Examiner* — Zulmariam Mendez
(74) *Attorney, Agent, or Firm* — Bayramoglu Law Offices LLC

(57) ABSTRACT

A method for extracting uranium with a coupling device of wind power generation and uranium extraction from seawater includes the following steps: adding oxygen vacancy (OV)-containing $In_2O_{3-x}$ to absolute ethanol, and subjecting a resulting mixture to stirring and ultrasonic treatment to obtain a solution of $In_2O_{3-x}$ in absolute ethanol; coating the solution uniformly on carbon cloth, and drying to obtain carbon cloth coated with OV-containing $In_2O_{3-x}$; inserting the coated carbon cloth (as a working electrode) and another blank carbon cloth (as a counter electrode) into a plastic carrier of a coupling device; fixing a small wind power
(Continued)

generation apparatus above the plastic carrier, and connecting the working electrode and the counter electrode to a storage battery of the apparatus via wires; and placing the coupling device in seawater, and after the storage battery is charged, energizing the working electrode and the counter electrode to extract uranium from the seawater.

10 Claims, 3 Drawing Sheets

(51) Int. Cl.

| | |
|---|---|
| ***C25C 5/00*** | (2006.01) |
| ***C25C 7/02*** | (2006.01) |
| ***C22B 60/02*** | (2006.01) |
| ***C25C 7/06*** | (2006.01) |
| ***C25C 1/22*** | (2006.01) |

(58) Field of Classification Search
CPC .. C25C 3/24; C25C 7/005; C25C 3/08; C25C 5/00
See application file for complete search history.

(56) References Cited

FOREIGN PATENT DOCUMENTS

| | | | |
|---|---|---|---|
| CN | 106824101 | A | 6/2017 |
| CN | 108404888 | A | 8/2018 |
| CN | 109477159 | A | 3/2019 |
| CN | 109821503 | A | 5/2019 |
| CN | 111004934 | A | 4/2020 |

OTHER PUBLICATIONS

Aznan Fazli Ismail, et al., Investigation of Activated Carbon Adsorbent Electrode for Electrosorption-Based Uranium Extraction From Seawater, Nucl. Eng. Technol., 2015, pp. 579-587, 47.

Yoshinori Suzuki, et al., Redox Behavior of Uranium(VI) Adsorbed onto a Phosphate-modified Indium Tin Oxide Electrode, Chem. Lett., 2013, pp. 888-890, 42.

METHOD FOR EXTRACTING URANIUM WITH COUPLING DEVICE OF WIND POWER GENERATION AND URANIUM EXTRACTION FROM SEAWATER

CROSS REFERENCE TO THE RELATED APPLICATIONS

This application is the national phase entry of International Application No. PCT/CN2020/136445, filed on Dec. 15, 2020, which is based upon and claims priority to Chinese Patent Application No. 201911319233.7, filed on Dec. 19, 2019, the entire contents of which are incorporated herein by reference.

TECHNICAL FIELD

The present disclosure relates to a method for extracting uranium from seawater, and in particular to a method for extracting uranium with a coupling device of wind power generation and uranium extraction from seawater.

BACKGROUND

Uranium is a raw material for nuclear power, and there are very few uranium reserves in natural ores. The ocean is a huge uranium reservoir. There is 4.29 billion tons of uranium in seawater, which is thousands of times that on land. In addition, uranium isotopes in seawater mainly include uranium-238 and uranium-235, which have the same natural abundance as that in terrestrial uranium ores. If the uranium resources in seawater can be effectively used, they will become an important supplement and guarantee for the stable supply of fuel for the nuclear power industry.

The current uranium extraction methods mainly include chemical precipitation, ion exchange, membrane separation, adsorption, and the like. The chemical precipitation process requires simple equipment, is low cost, and has high efficiency, but the polymer obtained therefrom needs to be further concentrated, dehydrated, and solidified. The ion exchange process has high extraction efficiency and prominent purification effect, but has the disadvantages of high cost, poor selectivity, and limited exchange capacity. The membrane separation process has the advantages of simple operation, low energy consumption, and strong adaptability, but has high requirements on the quality of raw water and often requires concurrent use with other water treatment technologies. The adsorption process requires the adsorbents to have large treatment capacity, strong adsorption selectivity, high corrosion resistance, and high mechanical strength, while existing adsorbing materials have low adsorption efficiency, high production cost, and difficult recycling in practical applications.

Oxygen vacancy (OV)-containing compounds can capture oxygen ions, and uranium in seawater exists in the form of uranyl ions, namely, uranium-oxygen complexes, such as $UO_2^{2+}$. Therefore, OVs can achieve the effect of indirect capture of uranium by capturing oxygen, such that OV-containing compounds can easily capture uranyl ions. Moreover, an electrochemical method is used to coat an OV-containing compound on carbon cloth, and a resulting carbon cloth is used as a working electrode; another blank carbon cloth is used as a counter electrode; and the electrodes are energized to fix uranium in seawater on the working electrode, thus realizing uranium extraction from seawater.

SUMMARY

One objective of the present disclosure is to solve at least the above-mentioned problems and/or disadvantages and provide at least the advantages to be described later.

In order to achieve the objective and other advantages according to the present disclosure, a method for extracting uranium with a coupling device of wind power generation and uranium extraction from seawater is provided, including the following steps:

step 1. adding OV-containing $In_2O_{3-x}$ to absolute ethanol, and subjecting a resulting mixture to stirring for 0.5 h to 1 h and then to ultrasonic treatment for 0.5 h to 1 h to obtain a solution of $In_2O_{3-x}$ in absolute ethanol;

step 2. coating the solution of $In_2O_{3-x}$ in absolute ethanol uniformly on carbon cloth; and after the coating is completed, naturally drying the carbon cloth to obtain carbon cloth coated with OV-containing $In_2O_{3-x}$;

step 3. inserting the carbon cloth coated with OV-containing $In_2O_{3-x}$ (as a working electrode) and another blank carbon cloth (as a counter electrode) into a plastic carrier of a coupling device, separately;

step 4. fixing a small wind power generation apparatus above the plastic carrier of the coupling device, and connecting the working electrode and the counter electrode to a storage battery of the small wind power generation apparatus via wires; and step 5. placing the coupling device in seawater, and after the small wind power generation apparatus charges the storage battery through wind, energizing the working electrode and the counter electrode through the storage battery to extract uranium from the seawater.

Preferably, in step 1, the ultrasonic treatment may be conducted at a power of 600 W to 1,200 W and a frequency of 28 KHz to 40 KHz; and a mass-volume ratio of the $In_2O_{3-x}$ to the absolute ethanol may be 50 mg:1 mL.

Preferably, in step 2, the solution of $In_2O_{3-x}$ in absolute ethanol may be dipped with a brush and uniformly brushed on the carbon cloth, and the brushing may be conducted in the same direction.

Preferably, the small wind power generation apparatus may be fixed on the plastic carrier via a support rod, and the support rod may be hollow internally, which is convenient for the insertion of the wires.

Preferably, the support rod may be made of a lightweight insulating material; and a surface of the support rod may be coated with an anticorrosive material.

Preferably, surfaces of the plastic carrier and the small wind power generation apparatus may be coated with an anticorrosive material.

Preferably, lower ends of the working electrode and the counter electrode may be located below the plastic carrier, and upper ends of the working electrode and the counter electrode may be located above the plastic carrier; and a total mass of the working electrode and the counter electrode below the plastic carrier may be greater than a total mass of the small wind power generation apparatus above the plastic carrier.

Preferably, a preparation method of the OV-containing $In_2O_{3-x}$ may include: preparing a solution of indium nitrate in isopropanol with a concentration of 0.024 mol/L to 0.028 mol/L, adding glycerin to the solution of indium nitrate in isopropanol, and subjecting a resulting mixture to stirring for 0.5 h to 1 h and then to ultrasonic treatment for 0.5 h to 1 h to obtain a mixed solution; transferring the mixed solution to a high-temperature and high-pressure polytetrafluoroethylene (PTFE) reactor, heating to 160° C. to 200°

C. at a heating rate of 5° C./min and holding at the temperature for 1 h to 3 h, and naturally cooling to room temperature; conducting solid-liquid separation (SLS), washing a resulting solid with deionized water and ethanol, and drying the solid in a vacuum drying oven at 60° C. to 80° C. for 10 h to 14 h to obtain a spherical indium hydroxide solid; dissolving the spherical indium hydroxide solid in deionized water, and conducting ultrasonic treatment for 0.5 h to 1 h; transferring a resulting solution to a high-temperature and high-pressure PTFE reactor, heating to 40° C. to 60° C. at a heating rate of 5° C./min and holding at the temperature for 1 h to 3 h, and naturally cooling to room temperature; washing a resulting solid with ethanol, and drying the solid in an oven at 60° C. to 80° C. for 10 h to 14 h to obtain a flaky indium hydroxide solid; and heating the flaky indium hydroxide solid to 350° C. to 450° C. at a heating rate of 10° C./min in an atmosphere with a hydrogen content of less than 5%, and conducting calcination for 1 h to 3 h to obtain a calcined OV-containing $In_2O_{3-x}$ sample.

Preferably, the solution of indium nitrate in isopropanol may be prepared by a method including: adding $In(NO_3)_3.4.5H_2O$ to isopropanol, and subjecting a resulting mixture to stirring for 0.5 h to 1 h and ultrasonic treatment for 0.5 h to 1 h to obtain the solution of indium nitrate in isopropanol; a mass ratio of the $In(NO_3)_3.4.5H_2O$ to the glycerin may be 3:(80-120); and a mass-volume ratio of the spherical indium hydroxide solid to the deionized water may be 1 g:(120-160) mL.

Preferably, the ultrasonic treatment may be conducted at a power of 600 W to 1,200 W and a frequency of 28 KHz to 40 KHz.

The present disclosure at least has the following beneficial effects: In the present disclosure, an OV-containing compound is coated on carbon cloth, and a resulting carbon cloth is used as a working electrode; another blank carbon cloth is used as a counter electrode; the working electrode and the counter electrode are arranged in a coupling device, and the coupling device is placed in seawater; and the working electrode and the counter electrode are energized through a storage battery of a small wind power generation apparatus to fix uranium in the seawater on the working electrode, thus realizing the extraction of uranium from the seawater. The extraction method is simple and easy to implement, and can be applied to the uranium extraction for a large area of seawater.

Other advantages, objects, and features of the present disclosure will be partially embodied through the following description, and some will be understood by those skilled in the art through the research and practice for the present disclosure.

DETAILED DESCRIPTION OF THE EMBODIMENTS

The present disclosure will be further described in detail below with reference to the accompanying drawings, such that those skilled in the art can implement the present disclosure with reference to the description.

It should be understood that terms, such as "have", "include", and "comprise" as used herein, do not exclude the presence or addition of one or more other elements or a combination thereof.

Example 1

A method for extracting uranium with a coupling device of wind power generation and uranium extraction from seawater was provided, including the following steps:

Step 1. 500 mg of OV-containing $In_2O_{3-x}$ was added to 10 mL of absolute ethanol, and a resulting mixture was stirred for 1 h and then subjected to ultrasonic treatment for 0.5 h to obtain a solution of $In_2O_{3-x}$ in absolute ethanol, where the ultrasonic treatment was conducted at a power of 1,200 W and a frequency of 40 KHz.

Step 2. The solution of $In_2O_{3-x}$ in absolute ethanol was dipped with a brush and uniformly brushed on a 10 cm×20 cm carbon cloth, where the brushing was conducted in the same direction; and after the brushing was completed, the carbon cloth was dried naturally to obtain carbon cloth coated with OV-containing $In_2O_{3-x}$.

Figure 1:
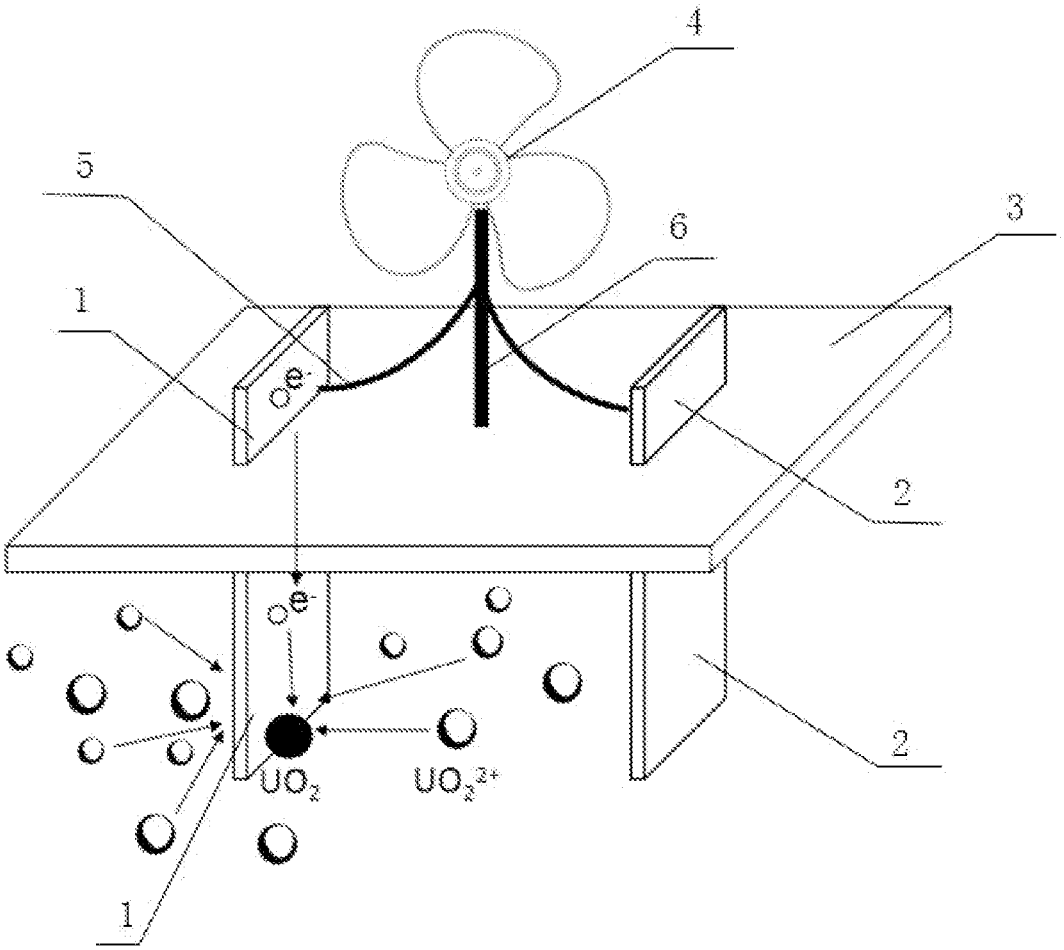
FIG. 1 is a schematic diagram illustrating a structure of the coupling device of wind power generation and uranium extraction from seawater according to the present disclosure.

Step 3. As shown in FIG. 1, the carbon cloth coated with OV-containing $In_2O_{3-x}$ (as a working electrode 1) and another blank carbon cloth (as a counter electrode 2) were inserted into a plastic carrier 3 of a coupling device, separately.

Step 4. A small wind power generation apparatus 4 was fixed above the plastic carrier 3 of the coupling device; the working electrode 1 and the counter electrode 2 were connected to a storage battery of the small wind power generation apparatus 4 via wires 5; and the small wind power generation apparatus 4 was fixed on the plastic carrier via a support rod 6. The support rod was hollow internally, which was convenient for the insertion of the wires. The support rod was made of a lightweight insulating material, and a surface of the support rod was coated with an anticorrosive material. Surfaces of the plastic carrier and the small wind power generation apparatus were coated with an anticorrosive material to avoid corrosion of the plastic carrier and the small wind power generation apparatus due to long-term retention in a seawater environment. Lower ends of the working electrode and the counter electrode were located below the plastic carrier, and upper ends of the working electrode and the counter electrode were located above the plastic carrier; and a total mass of the working electrode and the counter electrode below the plastic carrier was greater than a total mass of the small wind power generation apparatus above the plastic carrier, thereby preventing the device from being overturned due to excessive wind force.

Step 5. The coupling device was placed in 20 L of seawater with a $U^{6+}$ concentration of 3.4 μg/L; after the small wind power generation apparatus charged the storage battery through wind, the working electrode and the counter electrode were energized through the storage battery for 30 min to extract uranium from the seawater; and inductively coupled plasma mass spectrometry (ICP-MS) detection was conducted on the seawater obtained after the uranium extraction, and a detection result showed that the seawater had a $U^{6+}$ concentration of 1.2 μg/L, indicating that the working electrode exhibited a uranium extraction rate of 64.7%.

In the present disclosure, an OV-containing compound can capture oxygen ions, and among uranium-containing crystal complexes in seawater, most exist in the form of uranyl ions $UO_2^{2+}$. Therefore, OVs achieve the effect of indirect capture of uranium by capturing oxygen in $UO_2^{2+}$. Compared with compounds without OVs, OV-containing metal oxides are more likely to capture uranyl ions. The capture of oxygen is equivalent to the fixing of $UO_2^{2+}$. The working electrode and the counter electrode are energized by the storage battery of the small wind power generation apparatus to reduce $UO_2^{2+}$ to a $UO_2$ crystal (as shown in FIG. 1), which is fixed on the working electrode. Once a reduced $UO_2$ crystal nucleus appears, the subsequent uranium recovery process is equivalent to a crystal growth process, thereby realizing the extraction and enrichment of uranium in seawater.

A preparation method of the OV-containing $In_2O_{3-x}$ included the following steps: 3 g of $In(NO_3)_3.4.5H_2O$ was added to 300 mL of isopropanol, and a resulting mixture was stirred for 0.5 h and then subjected to ultrasonic treatment for 1 h to obtain a solution of indium nitrate in isopropanol; 100 g of glycerin was added to the solution of indium nitrate in isopropanol, and a resulting mixture was stirred for 0.5 h and then subjected to ultrasonic treatment for 0.5 h at a power of 800 W and a frequency of 35 KHz to obtain a mixed solution; the mixed solution was transferred to a high-temperature and high-pressure PTFE reactor, heated to 180° C. at a heating rate of 5° C./min and held at the temperature for 1 h, and then naturally cooled to room temperature; SLS was conducted, and a resulting solid was washed with deionized water and ethanol, and then dried in a vacuum drying oven at 60° C. for 12 h to obtain a spherical indium hydroxide solid; 1 g of the spherical indium hydroxide solid was added to 150 mL of deionized water, and a resulting mixture was subjected to ultrasonic treatment for 0.5 h at a power of 800 W and a frequency of 35 KHz; a resulting solution was transferred to a high-temperature and high-pressure PTFE reactor, heated to 50° C. at a heating rate of 5° C./min and held at the temperature for 1 h, and naturally cooled to room temperature; a resulting solid was washed with ethanol, and then dried in an oven at 60° C. for 12 h to obtain a flaky indium hydroxide solid; and the flaky indium hydroxide solid was heated to 400° C. at a heating rate of 10° C./min in an atmosphere with a hydrogen content of less than 5%, and calcination was conducted for 2 h to obtain a calcined OV-containing $In_2O_{3-x}$ sample (X in the $In_2O_{3-x}$ represents an OV content).

Figure 2:
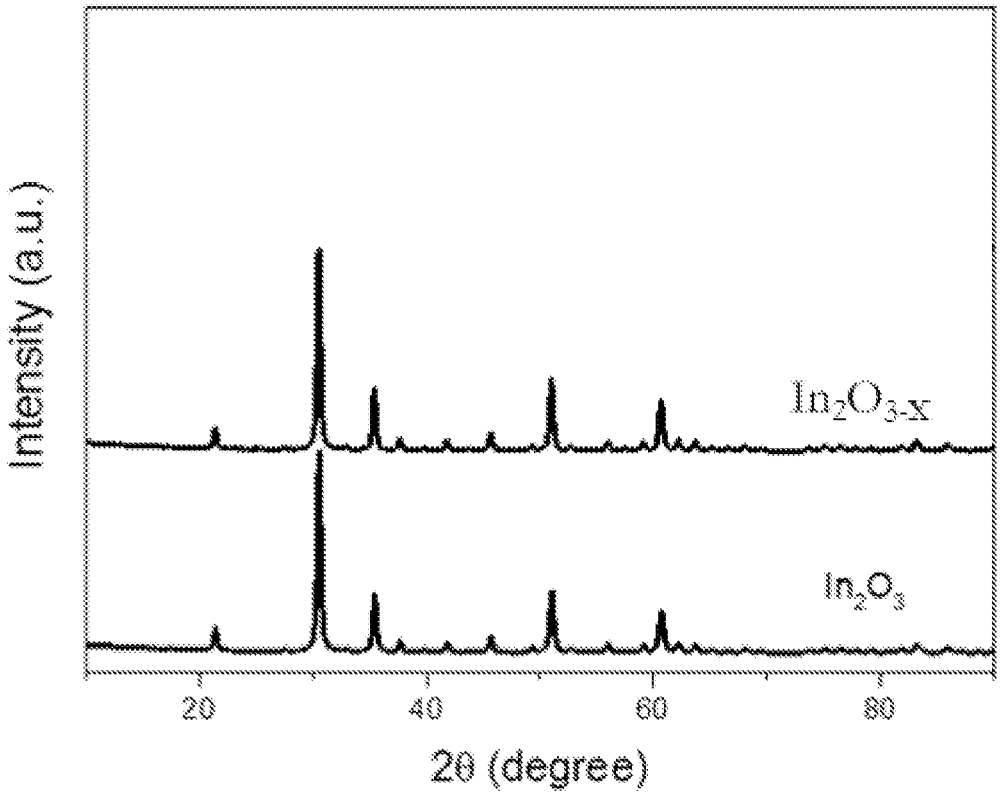
FIG. 2 shows X-ray diffraction (XRD) patterns of the OV-containing $In_2O_{3-x}$ sample of the present disclosure and pure $In_2O_3$.
Figure 3:
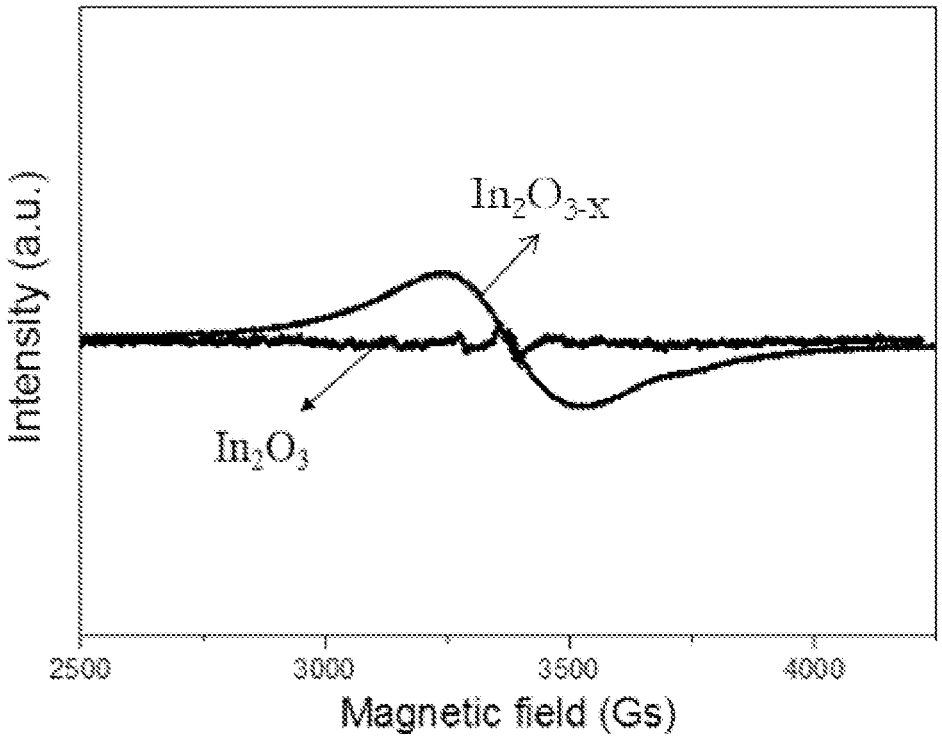
FIG. 3 shows electron-spin resonance (ESR) spectra of the OV-containing $In_2O_{3-x}$ sample of the present disclosure and pure $In_2O_3$.
Figure 4:
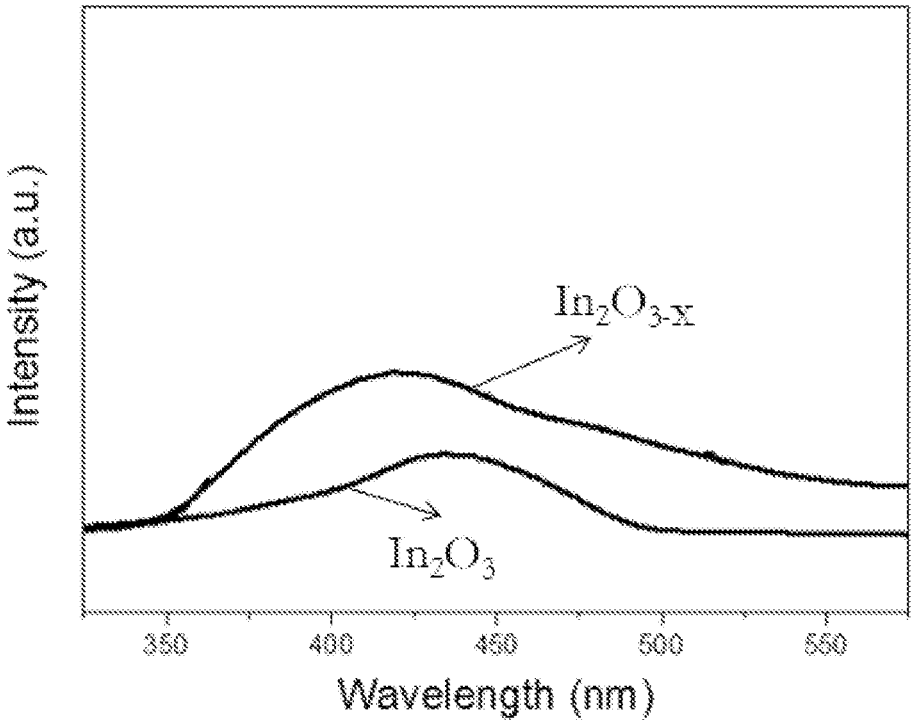
FIG. 4 shows photoluminescence (PL) spectra of the OV-containing $In_2O_{3-x}$, sample of the present disclosure and pure $In_2O_3$.
Figure 5:
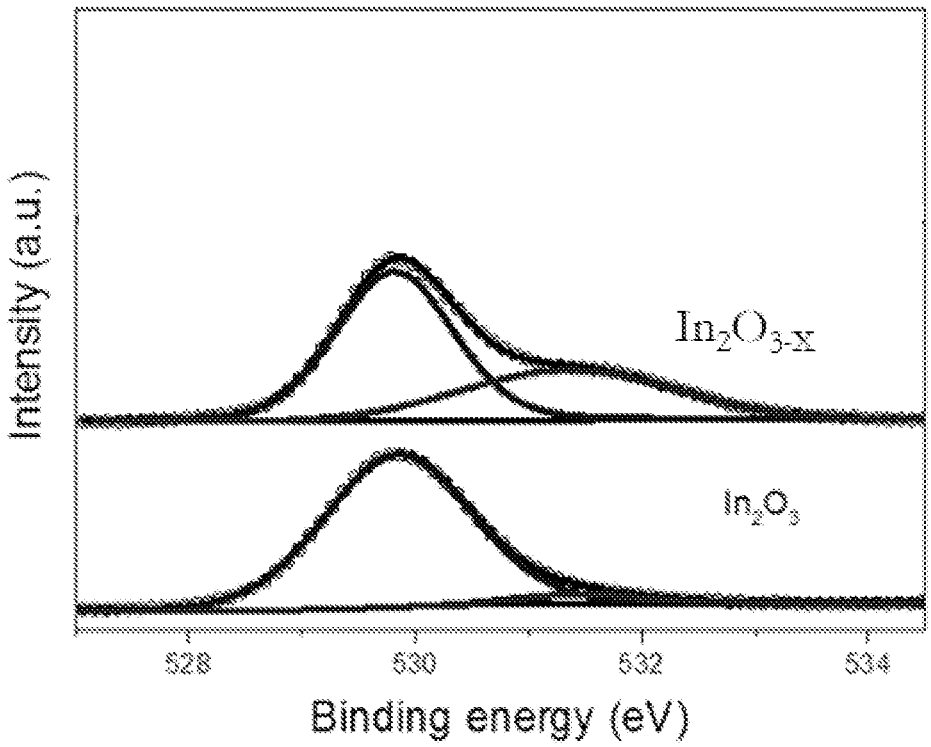
FIG. 5 shows X-ray photoelectron spectroscopy (XPS) spectra (O 1 s) of the OV-containing $In_2O_{3-x}$, sample of the present disclosure and pure $In_2O_3$.

It can be seen from FIG. 2 that the OV-containing $In_2O_{3-x}$ sample prepared by the present disclosure has a crystal phase consistent with that of pure $In_2O_3$, which is a cubic crystal phase. FIG. 3 shows ESR spectra of the OV-containing $In_2O_{3-x}$ sample prepared in the present disclosure and pure $In_2O_3$, where a signal appearing at about 3,400 Gs indicates the capture of electrons by OVs, and the stronger the signal, the higher the OV content in the prepared $In_2O_{3-x}$ sample. FIG. 4 shows PL spectra of the OV-containing $In_2O_{3-x}$ sample prepared in the present disclosure and pure $In_2O_3$, where a PL emission peak at 435 nm mainly indicates the occupation of OVs caused by the capture of electrons by photo-generated holes, and the stronger the signal, the higher the OV content in the prepared $In_2O_{3-x}$ sample. FIG. 5 shows XPS spectra (O 1 s) of the OV-containing $In_2O_{3-x}$ sample prepared in the present disclosure and pure $In_2O_3$, where two peaks can also be clearly identified in the O 1s core layer spectrum; the one at 529.8 eV indicates In—O—In bonds; and the other one at 531.4 eV indicates oxygen atoms near OVs, and the larger the peak area, the more oxygen atoms near OVs, indicating more OVs.

Example 2

A method for extracting uranium with a coupling device of wind power generation and uranium extraction from seawater was provided, including the following steps:

Step 1. 500 mg of OV-containing $In_2O_{3-x}$ was added to 10 mL of absolute ethanol, and a resulting mixture was stirred for 1 h and then subjected to ultrasonic treatment for 0.5 h to obtain a solution of $In_2O_{3-x}$ in absolute ethanol, where the ultrasonic treatment was conducted at a power of 1,200 W and a frequency of 40 KHz.

Step 2. The solution of $In_2O_{3-x}$, in absolute ethanol was dipped with a brush and uniformly brushed on a 10 cm×20 cm carbon cloth, where the brushing was conducted in the same direction; and after the brushing was completed, the carbon cloth was dried naturally to obtain carbon cloth coated with OV-containing $In_2O_{3-x}$.

Step 3. The carbon cloth coated with OV-containing $In_2O_{3-x}$ (as a working electrode) and another blank carbon cloth (as a counter electrode) were inserted into a plastic carrier of a coupling device, separately.

Step 4. A small wind power generation apparatus was fixed above the plastic carrier of the coupling device; the working electrode and the counter electrode were connected to a storage battery of the small wind power generation apparatus via wires; and the small wind power generation apparatus was fixed on the plastic carrier via a support rod. The support rod was hollow internally, which was convenient for the insertion of the wires. The support rod was made of a lightweight insulating material, and a surface of the support rod was coated with an anticorrosive material. Surfaces of the plastic carrier and the small wind power generation apparatus were coated with an anticorrosive material to avoid corrosion of the plastic carrier and the small wind power generation apparatus due to long-term retention in a seawater environment. Lower ends of the working electrode and the counter electrode were located below the plastic carrier, and upper ends of the working electrode and the counter electrode were located above the plastic carrier; and a total mass of the working electrode and the counter electrode below the plastic carrier was greater than a total mass of the small wind power generation apparatus above the plastic carrier, thereby preventing the device from being overturned due to excessive wind force.

Step 5. The coupling device was placed in 30 L of seawater with a $U^{6+}$ concentration of 3.5 μg/L; after the small wind power generation apparatus charged the storage battery through wind, the working electrode and the counter electrode were energized through the storage battery for 30 min to extract uranium from the seawater; and ICP-MS detection was conducted on the seawater obtained after the uranium extraction, and a detection result showed that the seawater had a $U^{6+}$ concentration of 1.6 μg/L, indicating that the working electrode exhibited a uranium extraction rate of 54.3%.

A preparation method of the OV-containing $In_2O_{3-x}$ included the following steps: 3 g of $In(NO_3)_3.4.5H_2O$ was added to 300 mL of isopropanol, and a resulting mixture was stirred for 0.5 h and then subjected to ultrasonic treatment for 1 h to obtain a solution of indium nitrate in isopropanol; 100 g of glycerin was added to the solution of indium nitrate in isopropanol, and a resulting mixture was stirred for 0.5 h and then subjected to ultrasonic treatment for 0.5 h at a power of 800 W and a frequency of 35 KHz to obtain a mixed solution; the mixed solution was transferred to a high-temperature and high-pressure PTFE reactor, heated to 180° C. at a heating rate of 5° C./min and held at the temperature for 1 h, and then naturally cooled to room temperature; SLS was conducted, and a resulting solid was washed with deionized water and ethanol, and then dried in a vacuum drying oven at 60° C. for 12 h to obtain a spherical indium hydroxide solid; 1 g of the spherical indium hydroxide solid was added to 150 mL of deionized water, and a resulting mixture was subjected to ultrasonic treatment for 0.5 h at a power of 800 W and a frequency of 35 KHz; a resulting solution was transferred to a high-temperature and high-pressure PTFE reactor, heated to 50° C. at a heating rate of 5° C./min and held at the temperature for 1 h, and naturally cooled to room temperature; a resulting solid was washed with ethanol, and then dried in an oven at 60° C. for 12 h to obtain a flaky indium hydroxide solid; and the flaky indium hydroxide solid was heated to 400° C. at a heating rate of 10° C./min in an atmosphere with a hydrogen content of less than 5%, and calcination was conducted for 2 h to obtain a calcined OV-containing $In_2O_{3-x}$ sample.

Example 3

A method for extracting uranium with a coupling device of wind power generation and uranium extraction from seawater was provided, including the following steps:

Step 1. 1000 mg of OV-containing $In_2O_{3-x}$ was added to 20 mL of absolute ethanol, and a resulting mixture was stirred for 1 h and then subjected to ultrasonic treatment for 0.5 h to obtain a solution of $In_2O_{3-x}$ in absolute ethanol, where the ultrasonic treatment was conducted at a power of 1,200 W and a frequency of 40 KHz.

Step 2. The solution of $In_2O_{3-x}$ in absolute ethanol was dipped with a brush and uniformly brushed on a 20 cm×40 cm carbon cloth, where the brushing was conducted in the same direction; and after the brushing was completed, the carbon cloth was dried naturally to obtain carbon cloth coated with OV-containing $In_2O_{3-x}$.

Step 3. The carbon cloth coated with OV-containing $In_2O_{3-x}$ (as a working electrode) and another blank carbon cloth (as a counter electrode) were inserted into a plastic carrier of a coupling device, separately.

Step 4. A small wind power generation apparatus was fixed above the plastic carrier of the coupling device; the working electrode and the counter electrode were connected to a storage battery of the small wind power generation apparatus via wires; and the small wind power generation apparatus was fixed on the plastic carrier via a support rod. The support rod was hollow internally, which was convenient for the insertion of the wires. The support rod was made of a lightweight insulating material, and a surface of the support rod was coated with an anticorrosive material. Surfaces of the plastic carrier and the small wind power generation apparatus were coated with an anticorrosive material to avoid corrosion of the plastic carrier and the small wind power generation apparatus due to long-term retention in a seawater environment. Lower ends of the working electrode and the counter electrode were located below the plastic carrier, and upper ends of the working electrode and the counter electrode were located above the plastic carrier; and a total mass of the working electrode and the counter electrode below the plastic carrier was greater than a total mass of the small wind power generation apparatus above the plastic carrier, thereby preventing the device from being overturned due to excessive wind force.

Step 5. The coupling device was placed in 40 L of seawater with a $U^{6+}$ concentration of 3.5 μg/L; after the small wind power generation apparatus charged the storage battery through wind, the working electrode and the counter electrode were energized through the storage battery for 30 min to extract uranium from the seawater; and ICP-MS detection was conducted on the seawater obtained after the uranium extraction, and a detection result showed that the seawater had a $U^{6+}$ concentration of 1.2 μg/L, indicating that the working electrode exhibited a uranium extraction rate of 65.7%.

A preparation method of the OV-containing $In_2O_{3-x}$ included the following steps: 3 g of $In(NO_3)_3.4.5H_2O$ was added to 300 mL of isopropanol, and a resulting mixture was stirred for 0.5 h and then subjected to ultrasonic treatment for 1 h to obtain a solution of indium nitrate in isopropanol; 100 g of glycerin was added to the solution of indium nitrate in isopropanol, and a resulting mixture was stirred for 0.5 h and then subjected to ultrasonic treatment for 0.5 h at a power of 800 W and a frequency of 35 KHz to obtain a mixed solution; the mixed solution was transferred to a high-temperature and high-pressure PTFE reactor, heated to 180° C. at a heating rate of 5° C./min and held at the temperature for 1 h, and then naturally cooled to room temperature; SLS was conducted, and a resulting solid was washed with deionized water and ethanol, and then dried in a vacuum drying oven at 60° C. for 12 h to obtain a spherical indium hydroxide solid; 1 g of the spherical indium hydroxide solid was added to 150 mL of deionized water, and a resulting mixture was subjected to ultrasonic treatment for 0.5 h at a power of 800 W and a frequency of 35 KHz; a resulting solution was transferred to a high-temperature and high-pressure PTFE reactor, heated to 50° C. at a heating rate of 5° C./min and held at the temperature for 1 h, and naturally cooled to room temperature; a resulting solid was washed with ethanol, and then dried in an oven at 60° C. for 12 h to obtain a flaky indium hydroxide solid; and the flaky indium hydroxide solid was heated to 400° C. at a heating rate of 10° C./min in an atmosphere with a hydrogen content of less than 5%, and calcination was conducted for 2 h to obtain a calcined OV-containing $In_2O_{3-x}$ sample.

The examples of the present disclosure have been disclosed above, which are not limited to the applications listed in the specification and implementations and can be absolutely applied to various fields suitable for the present disclosure. Additional modifications can be easily made by those skilled in the art. Therefore, without departing from the general concepts defined by the claims and equivalent scopes thereof, the present disclosure is not limited to specific details and the legends shown and described herein.

What is claimed is:

1. A method for extracting uranium with a coupling device of wind power generation and uranium extraction from seawater, comprising the following steps:

step 1, adding oxygen vacancy (OV)-containing $In_2O_{3-x}$ to absolute ethanol to obtain a first mixture, and subjecting the first mixture to stirring for 0.5 h to 1 h and then to ultrasonic treatment for 0.5 h to 1 h to obtain a solution of $In_2O_{3-x}$ in absolute ethanol;

step 2, coating the solution of $In_2O_{3-x}$ in absolute ethanol uniformly on carbon cloth; and after the coating is completed, naturally drying the carbon cloth to obtain carbon cloth coated with OV-containing $In_2O_{3-x}$;

step 3, using the carbon cloth coated with OV-containing $In_2O_{3-x}$ as a working electrode and blank carbon cloth as a counter electrode; and inserting the working electrode and the counter electrode into a plastic carrier of the coupling device, separately;

step 4, fixing a small wind power generation apparatus above the plastic carrier of the coupling device, and connecting the working electrode and the counter electrode to a storage battery of the small wind power generation apparatus via wires; and step 5, placing the coupling device in seawater, and after the small wind power generation apparatus charges the storage battery through wind, energizing the working electrode and the counter electrode through the storage battery to extract uranium from the seawater.

2. The method for extracting uranium with the coupling device of wind power generation and uranium extraction from seawater according to claim 1, wherein in step 1, the ultrasonic treatment is conducted at a power of 600 W to 1,200 W and a frequency of 28 KHz to 40 KHz; and a mass-volume ratio of the $In_2O_{3-x}$ to the absolute ethanol is 50 mg:1 mL.

3. The method for extracting uranium with the coupling device of wind power generation and uranium extraction from seawater according to claim 1, wherein in step 2, the solution of $In_2O_{3-x}$ in absolute ethanol is dipped with a brush and uniformly brushed on the carbon cloth in a same direction.

4. The method for extracting uranium with the coupling device of wind power generation and uranium extraction from seawater according to claim 1, wherein the small wind power generation apparatus is fixed on the plastic carrier via a support rod, and the support rod is hollow internally for an insertion of the wires.

5. The method for extracting uranium with the coupling device of wind power generation and uranium extraction from seawater according to claim 4, wherein the support rod is made of a lightweight insulating material; and a surface of the support rod is coated with an anticorrosive material.

6. The method for extracting uranium with the coupling device of wind power generation and uranium extraction from seawater according to claim 1, wherein surfaces of the plastic carrier and the small wind power generation apparatus are coated with an anticorrosive material.

7. The method for extracting uranium with the coupling device of wind power generation and uranium extraction from seawater according to claim 1, wherein lower ends of the working electrode and the counter electrode are located below the plastic carrier, and upper ends of the working electrode and the counter electrode are located above the plastic carrier; and a total mass of the working electrode and the counter electrode below the plastic carrier is greater than a total mass of the small wind power generation apparatus above the plastic carrier.

8. The method for extracting uranium with the coupling device of wind power generation and uranium extraction from seawater according to claim 1, wherein a preparation method of the OV-containing $In_2O_{3-x}$ comprises: preparing a solution of indium nitrate in isopropanol with a concentration of 0.024 mol/L to 0.028 mol/L, adding glycerin to the solution of indium nitrate in isopropanol to obtain a second mixture, and subjecting the second mixture to stirring for 0.5 h to 1 h and then to ultrasonic treatment for 0.5 h to 1 h to obtain a mixed solution; transferring the mixed solution to a high-temperature and high-pressure polytetrafluoroethylene (PTFE) reactor, heating the mixed solution to a first temperature of 160° C. to 200° C. at a heating rate of 5° C./min and holding at the first temperature for 1 h to 3 h, and naturally cooling to room temperature; conducting solid-liquid separation (SLS), washing a resulting solid with deionized water and ethanol to obtain a washed solid, and drying the washed solid in a vacuum drying oven at 60° C. to 80° C. for 10 h to 14 h to obtain a spherical indium hydroxide solid; dissolving the spherical indium hydroxide solid in deionized water, and conducting ultrasonic treatment for 0.5 h to 1 h; transferring a resulting solution to the high-temperature and high-pressure PTFE reactor, heating the resulting solution to a second temperature of 40° C. to 60° C. at a heating rate of 5° C./min and holding at the second temperature for 1 h to 3 h, and naturally cooling to room temperature; washing with ethanol, and drying in an oven at 60° C. to 80° C. for 10 h to 14 h to obtain a flaky indium hydroxide solid; and heating the flaky indium hydroxide solid to 350° C. to 450° C. at a heating rate of 10° C./min in an atmosphere with a hydrogen content of less than 5%, and conducting calcination for 1 h to 3 h to obtain a calcined OV-containing $In_2O_{3-x}$ sample.

9. The method for extracting uranium with the coupling device of wind power generation and uranium extraction from seawater according to claim 8, wherein the solution of indium nitrate in isopropanol is prepared by a method comprising: adding $In(NO_3)_3.4.5H_2O$ to isopropanol to obtain a third mixture, and subjecting the third mixture to stirring for 0.5 h to 1 h and ultrasonic treatment for 0.5 h to 1 h to obtain the solution of indium nitrate in isopropanol; a mass ratio of the $In(NO_3)_3.4.5H_2O$ to the glycerin is 3:(80-120); and a mass-volume ratio of the spherical indium hydroxide solid to the deionized water is 1 g:(120-160) mL.

10. The method for extracting uranium with the coupling device of wind power generation and uranium extraction from seawater according to claim 8, wherein the ultrasonic treatment is conducted at a power of 600 W to 1,200 W and a frequency of 28 KHz to 40 KHz.

* * * * *